United States Patent [19]

Haaser

[11] Patent Number: 4,730,977

[45] Date of Patent: Mar. 15, 1988

[54] THRUST BEARING LOADING ARRANGEMENT FOR GAS TURBINE ENGINES

[75] Inventor: Frederic G. Haaser, Montgomery, Ohio

[73] Assignee: General Electric Company, Cincinnati, Ohio

[21] Appl. No.: 948,370

[22] Filed: Dec. 31, 1986

[51] Int. Cl.[4] ..... F01D 3/00

[52] U.S. Cl. ..... 415/104; 415/105; 60/39.25

[58] Field of Search ..... 415/104, 105, 106, 107, 415/131, 132; 416/170 R; 60/39.31, 39.091, 39.25, 39.83

[56] References Cited

U.S. PATENT DOCUMENTS

| | | | |
|---|---|---|---|
| 1,344,193 | 6/1920 | Wilson | 415/107 |
| 2,530,477 | 11/1950 | Ostmar | 230/122 |
| 3,433,020 | 3/1969 | Earle et al. | 415/106 |
| 3,505,813 | 4/1970 | McCarthy | 60/39.31 |
| 4,159,888 | 7/1979 | Thompson | 415/105 |
| 4,251,985 | 2/1981 | Sullivan | 60/39.29 |
| 4,578,018 | 3/1986 | Pope | 415/14 |

FOREIGN PATENT DOCUMENTS 492477 9/1938 United Kingdom .

*Primary Examiner*—Albert J. Makay
*Assistant Examiner*—David W. Westphal
*Attorney, Agent, or Firm*—Douglas S. Foote; Derek P. Lawrence

[57] ABSTRACT

A plurality of openings are provided in a stationary wall of a gas turbine engine aft of the compressor discharge to admit compressor discharge air into a sealed cavity formed between the stationary wall and the rotor of the gas turbine engine. A valve, biased to an open position, is associated with each of the openings so that under low speed conditions some of the compressor discharge air is admitted to the cavity to provide supplementary axial force on the rotor in one direction to prevent crossover under such conditions. Under higher speed conditions the increase in compressor discharge pressure overcomes the force biasing the valve to its open position, thereby causing the valve to close and terminate flow of compressor discharge air to the cavity, terminating the aforementioned supplementary axial force on the rotor. Each of the valves includes a housing surrounding the corresponding opening in the stationary wall and a valve piston within the housing is biased to an open position by open or more belleville springs positioned within the housing.

12 Claims, 5 Drawing Figures

THRUST BEARING LOADING ARRANGEMENT FOR GAS TURBINE ENGINES

BACKGROUND OF THE INVENTION

This invention relates to gas turbine engines and, more particularly a thrust bearing loading arrangement for insuring unidirectional thrust on a ball bearing supporting one end of the rotor of a gas turbine engine.

The compressor discharge pressure of a gas turbine engine varies over a wide range through the normal operating range of a gas turbine engine from low or idling speed to maximum speed of the engine. This variation in operating conditions causes a substantial variation in the axial force exerted on the rotor of a gas turbine engine. Thus, at high operating speeds there may be a substantial axial load on the rotor in an aft or forward direction, thereby causing a corresponding axial force in the aft or forward direction on the thrust bearing supporting the rotor. On the other hand, at low or idling speeds, this axial force on the rotor is substantially reduced and may shift to the opposite direction, resulting in a condition known as crossover occurring at the time when the force exerted on the rotor, and correspondingly on the thrust bearing, changes from an aft direction to a forward direction or vice versa. Such crossover is undesirable because at the point of crossover the unloaded ball bearing is free to travel radially within its races. This unloaded condition of the ball bearing of the thrust bearing and the resultant radial movement of the unloaded ball bearing permits radial movement and/or orbiting of the rotor. For most efficient operation of a gas turbine engine, the clearance between the tips of the blades of the rotor and the surrounding stationary shroud is kept to a minimum. As a result, radial movement or orbiting of the rotor can cause the blade tips to engage the surrounding structure, resulting in wear of these tips and the surrounding structure. Such wear increases the compressor blade tip clearance resulting in a reduced stall margin and performance for the engine and the aircraft in which it is employed.

The unloaded thrust bearing also permits axial movement of the rotor. Since the compressor blade tips are slanted, this axial movement accentuates the increased clearance resulting from the aforementioned wear of the blade tips and surrounding structure, thereby compounding the problem.

One approach to the solution of this problem is to increase the thrust loading in an aft or forward direction so that, even under very low speed and idling conditions, the axial force on the rotor is still exerted in a consistent direction, thus providing adequate thrust load at idle and low speeds and preventing crossover. However, this approach introduces another problem in that there may then be an excessive thrust load at high speeds and high power, thereby reducing bearing life.

The present invention provides an arrangement for insuring against crossover at low speeds but avoiding any excessive thrust load at high speed operation of the engine.

Accordingly, it is an object of this invention to provide a thrust bearing loading arrangement which insures against crossover of the axial load exerted on the thrust ball bearing of a gas turbine engine, while at the same time avoiding excessive thrust load under conditions where the engine is operating at high power or maximum power.

SUMMARY OF THE INVENTION

In carrying out this invention, in one form thereof, advantage is taken of the availability of a sealed cavity between the moving rotor and a stationary portion or wall of a conventional gas turbine engine. More specifically, under one set of conditions where it is desired to increase the aft force to prevent crossover, such cavity is chosen which has an aft wall of greater area than the forward wall thereof so that pressure exerted within the cavity exerts an aft force on the rotor and on the thrust bearing associated with the rotor. A plurality of openings are provided in the stationary wall aft of the compressor discharge so that, under proper conditions, compressor discharge air may flow into the cavity to exert an axial force in an aft direction on the rotor. A valve, biased to an open position, is associated with each of the openings so that under low speed conditions some of the compressor discharge air is admitted to the cavity to provide supplementary axial force in an aft direction on the rotor, and thereby avoid crossover under such conditions. On the other hand, under higher speed conditions the increase in compressor discharge pressure overcomes the force biasing the valve to its open position, thereby causing the valve to close and terminate flow of compressor discharge air to the cavity, terminating the aforementioned supplementary axial force on the rotor. In a specific embodiment of the invention, each of the valves includes a housing surrounding the corresponding opening in the stationary wall and a valve piston within the housing is biased to an open position by one or more belleville springs positioned within the housing. Thus, by the present invention, an appropriate force in an aft direction is provided on the rotor and the thrust bearing to insure against crossover at low speed conditions. However, the supplementary axial force is terminated under higher speed conditions and thereby excessive loading of the thrust bearing is avoided. The above-summarized embodiment is applicable, as indicated, to conditions where it is desired to increase the aft force to prevent crossover. It will be understood that under conditions where it may be necessary to increase the forward force to prevent crossover the invention is equally applicable. Under the latter conditions, the cavity would be chosen so as to have its forward wall of greater area than its aft wall.

DESCRIPTION OF THE PREFERRED EMBODIMENT

Figure 1:
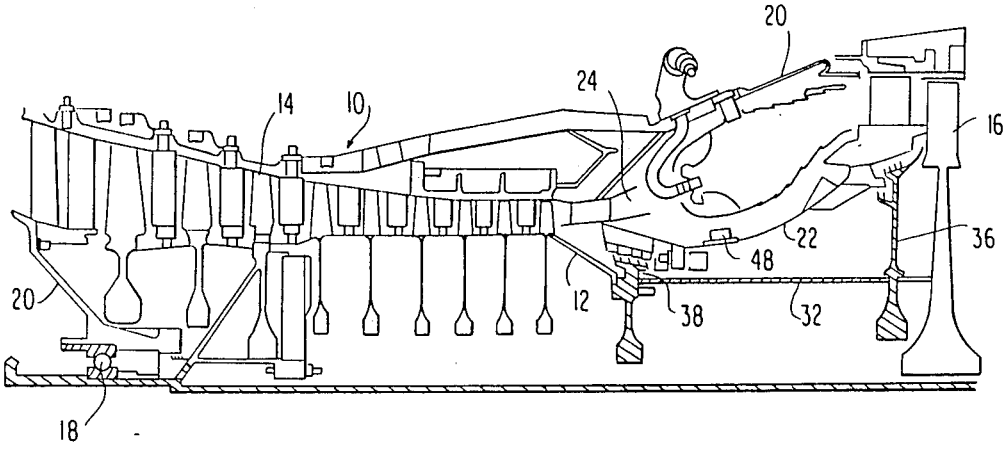
FIG. 1 is a sectional view of an upper half portion of a gas turbine engine showing elements of the subject invention but, for simplicity, not including full details of the engine.

Referring to FIG. 1, there is shown a portion of a conventional gas turbine engine 10. This engine includes a rotor generally designated by the numeral 12, the rotor 12 including a compressor 14 and a turbine 16 connected by a common shaft for rotation as an integral assembly. The rotor is supported for rotation by a plurality of bearings, but for purposes of this invention, only the thrust bearing, indicated at 18, is shown.

The rotor rotates within a stationary structure generally indicated by the numerals 20, the stationary structure including a stationary wall 22. The stationary wall 22 is positioned aft of the discharge path 24 for air being discharged from the compressor 14.

Figure 3:
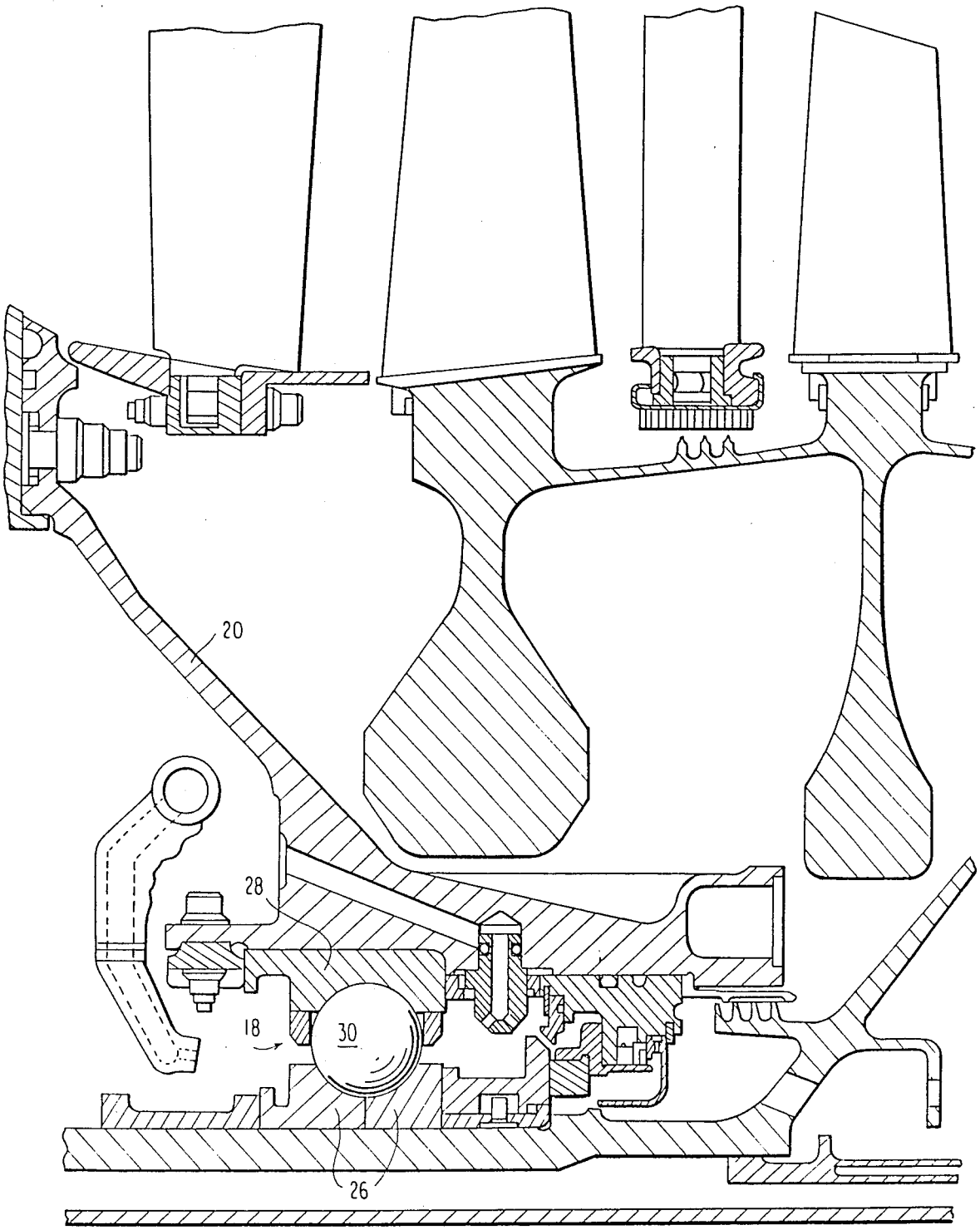
FIG. 3 is a substantially enlarged view of the extreme left-hand portion of the gas turbine engine shown in FIG. 1, illustrating the thrust bearing.

As best shown in FIG. 3, the thrust bearing includes a rotating inner race 26 secured to the rotor for rotation therewith and a stationary outer race 28 secured to the stationary support structure 20 of the gas turbine engine. A plurality of ball bearings, one of which is shown at 30, are provided between the inner and outer races 26, 28. In this embodiment of the invention, during most of the operating range of the engine an axial force is exerted in an aft direction on the thrust bearing and the balls therein by the rotor 12. Under low speed and idling conditions, however, the engine is susceptible to crossover, that is, the force exerted on the thrust bearing may change from an aft direction to a forward direction, as will be discussed in more detail later.

Figure 2:
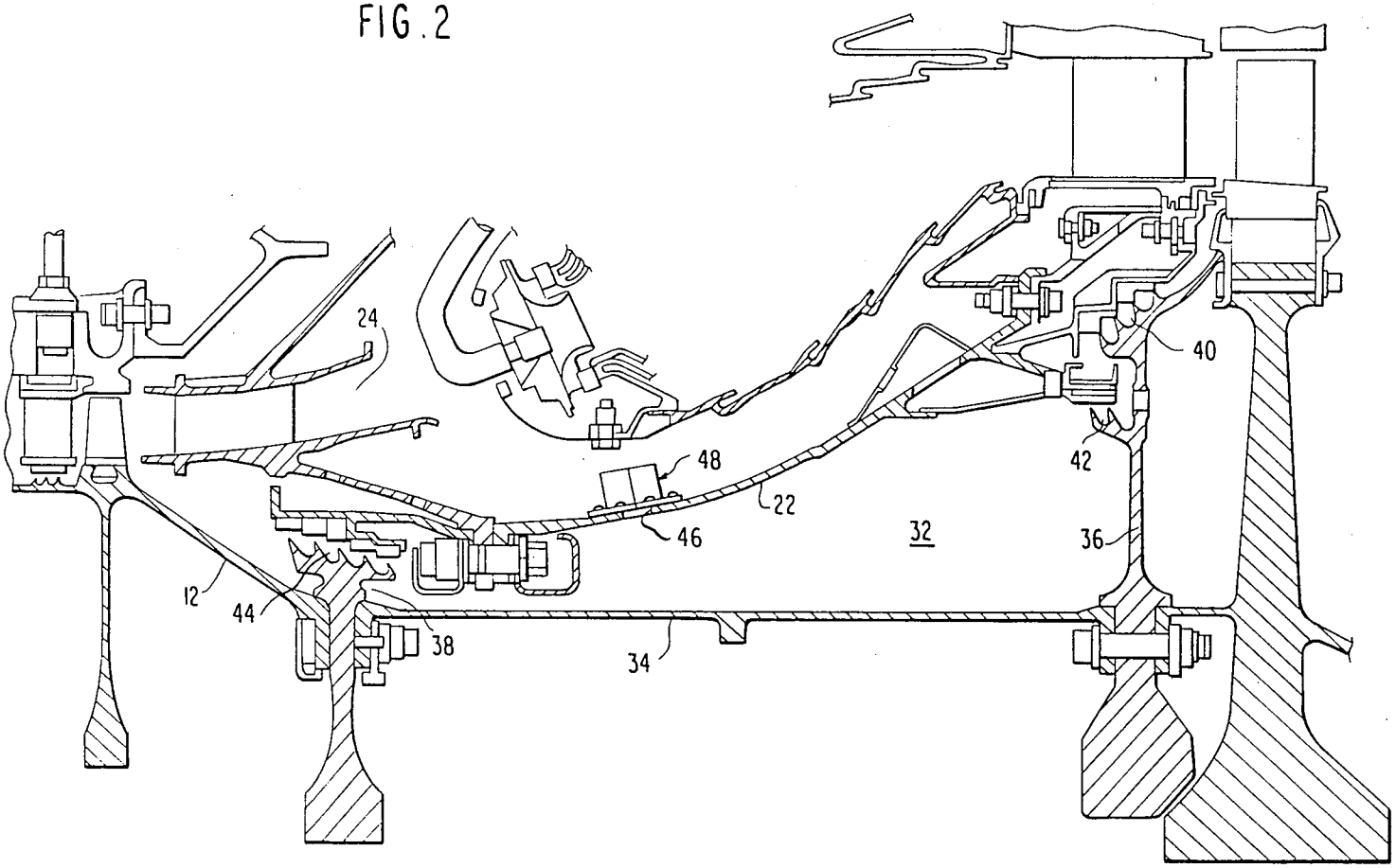
FIG. 2 is an enlarged view of a portion of the right-hand section of FIG. 1 to further illustrate the relationship of the elements of the subject invention.

In order to prevent the occurrence of such crossover, the present invention takes advantage of a preexisting cavity 32, as shown in FIG. 1 and in greater detail in FIG. 2, disposed in the gas turbine engine aft of the compressor discharge area 24. The cavity 32 is formed by the stationary wall 22, a second wall 34 which forms part of the structure of the rotor 12, an aft wall 36 and a forward will 38. As can be seen from FIG. 2 the axial piston area of the aft wall 36 is substantially greater than that of the forward wall 38 owing to its larger diameter. Seals 40 and 42 are formed at the aft portion of the cavity 32 for providing sealing engagement between the rotor and the stationary structure at these points. A further seal 44 is provided between the rotor and the stationary structure at the forward wall 38 to complete the sealed cavity 34.

In the specific preferred embodiment of the invention a plurality of openings 46 are provided in the stationary wall 22 for communication with the interior of the cavity 32, thereby providing for flow of compressor discharge air from the area 24 to the cavity 32. The number of openings employed may be varied as desired, and, if desired, a single opening may be employed, under proper conditions, to admit compressor discharge air into the cavity 32. However, the preferred embodiment utilizes a plurality of openings 46 evenly distributed about the circumferential extent of the wall 22.

In order to control the admission of compressor discharge air into the cavity 32 a valve 48 is associated with each opening 46. When the valve is open, compressor discharge air is admitted through the opening 46 into the cavity 32. Since, as indicated earlier, the aft wall 36 of the cavity 32 is of substantially greater axial piston area than the forward wall 38, the compressed air from the compressor admitted through the openings 46 exerts a net aft axial force on the rotor 12 and hence on the thrust bearing 18.

Each valve 48 is constructed so as to be biased toward its open position. Thus, under low speed and idling conditions of the gas turbine engine, when the compressor discharge pressure is at a lower value, the valve is maintained in its open position by this biasing force. Hence, under such conditions, an additional aft force against the wall 36 is exerted by the compressor discharge air admitted through the openings 46 so as to prevent the force on the thrust bearing from shifting under these conditions to a forward direction and thereby prevent crossover. However, as the speed of the engine increases and the compressor discharge pressure correspondingly increases, this pressure exceeds the biasing force of the valve 48 and the valve internal mechanism is moved, by the compressor discharge pressure, to its closed position against the aforementioned biasing force. Thus, under these conditions no compressor discharge air is admitted to the cavity 32 and the aforementioned axial force in an aft direction on the wall 36 thereof is eliminated, thereby avoiding excessive pressure on the thrust bearing under such higher speed, higher power operating conditions.

Figure 4:
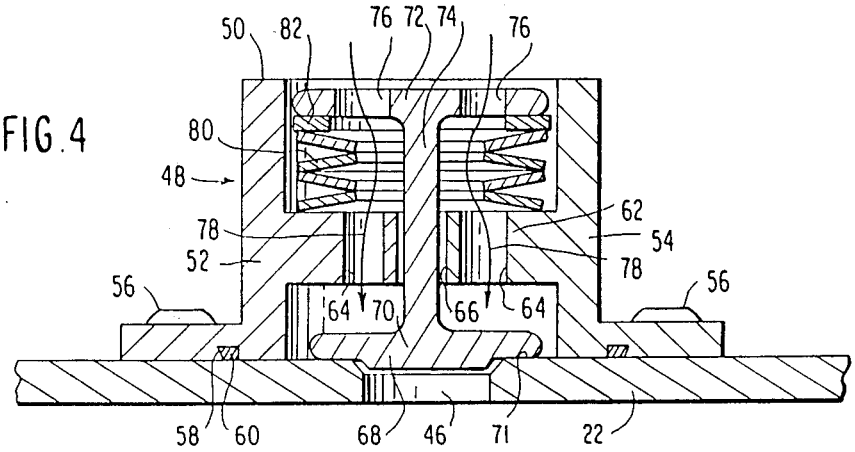
FIG. 4 is an enlarged view of the control valve employed in the subject invention.

Details of the valve employed in the preferred embodiment of this invention are shown in FIG. 4. In the preferred embodiment illustrated in FIG. 5, the valve is a poppet valve and includes a housing 50 which is formed in two halves 52, 54. Each of the housing halves 52, 54 is secured to the stationary wall 22 by two or more fasteners, one of which is shown for each housing half at 56. The fasteners 56 may be conventional machine screws threaded into openings in the stationary wall 22. Two or more such fasteners are provided for each housing half to insure that a minimum of two fasteners must fail before the housing could become disassembled. To provide more effective seating of the housing on the stationary wall 22 and to reduce the entry of contaminants, such as environmental dust, into the interior of the housing or cavity 32, where such contaminants could affect the seating of the valve or engine cooling passages, the face of the housing which engages the stationary wall 22 may be formed to include a recess 58, within which is received a seating gasket 60.

The housing 50 is formed to include a shelf 62 internally thereof, the shelf being spaced from both the top and bottom of the housing. The shelf 62 includes multiple passages 64 for admitting compressor discharge air and a central passage 66 for receiving a valve stem. A valve piston 68 is mounted within the housing 50 for controlling flow of air through the opening 46. The valve piston is formed to include a lower seating element 70 for engaging a valve seat 71 on the stationary wall 22 to close the opening 46. The valve piston 68 further includes an upper portion 72 spaced from the lower portion 70 and connected thereto by a central valve stem 74, the valve stem 74 being received within the aforementioned central passage 66 of the shelf 62 of the housing. The upper portion 72 of the valve element includes openings 76 for passage of compressor discharge air therethrough, as indicated by the arrows 78.

In order to bias the valve piston 68 to its open position, a plurality of biasing elements 80 are interposed between the shelf 62 of the housing and the upper portion 72 of the valve piston 68. In the particular form shown in FIG. 4, which is the preferred embodiment of the invention, these elements 80 are belleville springs formed of high temperature sheet metal capable of withstanding the temperature of the compressor discharge air without undergoing permanent deformation.

For a lower temperature application a coil spring could be employed in lieu of the belleville springs. In the embodiment shown, four such belleville springs are employed to provide the biasing force to the valve piston 68, but a greater or lesser number may be employed depending on the magnitude of the biasing force desired. A flat, nonresilient washer 82 is provided between the belleville springs 80 and the upper portion 72 of the valve piston 68.

The combination of belleville springs and flat, nonresilient washers permits flexibility to be introduced in the operating characteristics of the valve while still employing a housing of a standard size and a valve piston of standard size. Thus, where a plurality of such valves are employed, as is the case in the preferred embodiment, the biasing force exerted on the several valve pistons may be varied by increasing or decreasing the number or stiffness of belleville springs employed. The additional space made available, for example by eliminating one or more of the belleville springs shown in FIG. 4 being filled by adding the necessary number of flat washers 82.

As can be seen from FIG. 4 the belleville springs urge the valve element 68 upwardly toward its open position so as to afford a path for admission of compressor discharge air to the cavity 32 under the low speed and idling conditions of the engine when the compressor discharge pressure is at a lower value. Conversely, under higher operating speeds of the engine, where the compressor discharge pressure is at a higher value, this pressure, exerted on the valve piston 68, overcomes the biasing force provided by the belleville springs 80 and forces the valve piston 68 to its closed position, blocking flow of compressor discharge air to the cavity 32.

Figure 5:
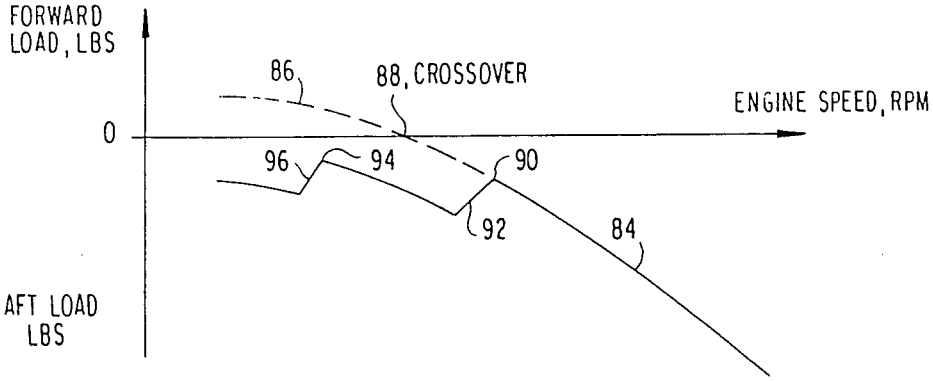
FIG. 5 is a diagram illustrating the rotor load under various conditions.

The operation of the subject invention may be further understood from the diagram shown in FIG. 5. As there shown the aft load on the rotor gradually decreases along the line 84 as the engine speed decreases. Were the conditions to remain unchanged as the engine speed further decreases the load would continue along the dashed line 86 and change from an aft load to a forward load at the crossover point indicated at 88. With the subject invention, however, when the conditions reach the point indicated at 90 the valve pistons 68 are moved by the biasing force exerted by the belleville springs 80 to the open position. This admits the compressor discharge air to the cavity 32 and exerts an additional axial force in an aft direction on the rotor 12, increasing the aft load along the line 92 and preventing the load from reaching the crossover point 88.

It has been indicated earlier that the biasing force exerted by each valve may be varied by changing the number or stiffness of belleville springs employed. Thus, if desired, some of the valves may be constructed with fewer belleville springs, and hence smaller biasing force, than other valves. With such an arrangement the valves having the greater biasing force will open first as the engine speed decreases, and the valves having the smaller biasing force will open later. Thus, the valves can be arranged to open successively rather than simultaneously as the engine speed decreases. Referring again to FIG. 5, some of the valves, among the plurality of valves used, may be constructed to have a higher biasing force so as to open at the point indicated at 90, providing an initial increase in the supplementary aft loading force on the thrust bearing. A second group of valves may be constructed to have a lesser biasing force, and these valves will be caused to open at the point indicated at 94 in FIG. 5, introducing further compressor discharge air and greater pressure into the cavity 32 and effecting a further increase in aft loading along the line 96.

Thus, the subject invention provides a substantial amount of flexibility in design. Preferably a plurality of valves are distributed circumferentially in a uniform manner about the stationary wall 22 to admit compressor discharge air at a plurality of points into the cavity 32. All of these valves may be constructed so as to open simultaneously, that is all of the valves may be constructed to have the same biasing force. Alternatively, the biasing force of some of the valves may be made higher than that of others so that valves, or groups of valves, will open successively, as described above. Further, under some conditions a single opening in the stationary wall 22 and a single controlling valve might be employed. Also, while a particular poppet valve structure has been illustrated and described, and this is the presently preferred form, it is apparent that other types of valves may be employed, if desired, to control the flow of compressor discharge air into the cavity 32. While, for simplicity of description, the invention has been set forth as applied to conditions where an additional aft force is applied to prevent crossover, it will be clear that the invention is equally applicable, as pointed out earlier in this application, to conditions where it is necessary to apply an additional forward force to prevent crossover. Such modifications, and others which will occur to those skilled in the art, are considered within the scope of this invention and are intended to be covered by the appended claims.

It is claimed:

1. In a gas turbine engine including a stationary wall and a rotor comprising a compressor and a turbine, a thrust bearing loading arrangement comprising:

(a) means for mounting said rotor for rotating movement, said means including a thrust ball bearing;

(b) said engine including at least one sealed cavity between a portion of said rotor and said stationary wall;

(c) said cavity including an aft wall and a forward wall, one of said walls having a greater surface area than the other of said walls;

(d) said stationary wall having an opening aft of said compressor for providing a path for flow of compressor discharge air into said cavity to increase the load on said thrust bearing;

(e) means responsive to compressor discharge pressure for controlling flow of compressor discharge air into said cavity to insure unidirectional loading on said thrust bearing throughout the normal operating range of said engine.

2. The thrust bearing loading arrangement as recited in claim 1 including a plurality of openings in said stationary wall for providing a plurality of paths for flow of compressor discharge air into said cavity and a plurality of said means for controlling flow of compressor discharge air through said openings into said cavity.

3. The thrust bearing loading arrangement as recited in claim 2 wherein each of said means for controlling flow of discharge air through said openings comprises:

(a) a housing;

(b) means for securing each of said housings to said stationary wall surrounding a corresponding one of said openings;

(c) means providing a valve seat at each of said openings;

(d) a valve piston positioned for engaging each of said seats and movable within its corresponding housing between an open and a closed position;

(e) all of said housings having the same predetermined height;

(f) a plurality of flat nonresilient washers and a plurality of belleville springs arranged in a stack in each of said housings for biasing the corresponding valve piston toward its open position;

(g) the number of said flat washers and the number of said belleville springs in each of said housings being varied to vary the biasing force on the corresponding valve element while maintaining substantially the same height for each of said stacks of springs and washers;

(h) whereby said valves controlling said plurality of openings are arranged to open and close at different times so as to vary said thrust bearing loading in stepped fashion while employing the same standard parts.

4. The thrust bearing loading arrangement as recited in claim 1 wherein said means for controlling flow of compressor discharge air through said opening comprises a valve, said valve including means for biasing said valve to an open position, said valve being moved to its closed position when said compressor discharge pressure exceeds the force exerted by said biasing means.

5. The thrust bearing loading arrangement as recited in claim 4 wherein said biasing means comprises a spring.

6. The thrust bearing loading arrangement as recited in claim 5 wherein said spring is a belleville spring.

7. The thrust bearing loading arrangement as recited in claim 4 wherein said valve comprises:

(a) a housing;

(b) means for securing said housing to said stationary wall surrounding said opening;

(c) means providing a valve seat at said opening;

(d) a valve piston positioned for engaging said seat and movable within said housing between an open and a closed position; and (e) a spring disposed in said housing and engaging said valve piston for biasing said valve piston to its open position.

8. The thrust bearing loading arrangement as recited in claim 7 wherein said housing is made in two complementary halves to facilitate assembly of said valve element and said spring therein.

9. The thrust bearing loading arrangement as recited in claim 8 wherein said securing means for each of said housing halves comprises at least two fasteners engaging said stationary wall whereby said housing cannot become disassembled unless at least two or more fasteners fail.

10. The thrust bearing loading arrangement as recited in claim 7 wherein said spring is a belleville spring.

11. The thrust bearing loading arrangement as recited in claim 10 wherein said housing has a predetermined height, a plurality of belleville springs are employed, and said biasing force is varied by substituting flat nonresilient washers for one or more of said belleville springs.

12. The thrust bearing loading arrangement as recited in claim 7 wherein the face of said housing engaging said stationary wall is formed to include a recess therein, and a sealing gasket is disposed within said recess.

* * * * *